US008807866B2

(12) United States Patent
Buschmann et al.

(10) Patent No.: US 8,807,866 B2
(45) Date of Patent: Aug. 19, 2014

(54) METHOD AND ROAD FINISHER FOR LAYING A COMPACTED FINISHING LAYER

(75) Inventors: Martin Buschmann, Neustadt (DE); Roman Munz, Neustadt (DE); Klaus Bertz, Dittelsheim-Hessloch (DE); Ralf Weiser, Ladenburg (DE)

(73) Assignee: Joseph Vogele AG, Ludwigshafen/Rhein (DE)

( * ) Notice: Subject to any disclaimer, the term of this patent is extended or adjusted under 35 U.S.C. 154(b) by 232 days.

(21) Appl. No.: 13/040,526

(22) Filed: Mar. 4, 2011

(65) Prior Publication Data

US 2011/0229266 A1 Sep. 22, 2011

(30) Foreign Application Priority Data

Mar. 18, 2010 (EP) ..... 10002896

(51) Int. Cl.
*E01C 19/30* (2006.01)
*E01C 19/22* (2006.01)

(52) U.S. Cl.
USPC ..... 404/74; 404/84.1

(58) Field of Classification Search
USPC ..... 404/74, 84.1, 96, 102, 114, 133.05, 404/133.2
See application file for complete search history.

(56) References Cited

U.S. PATENT DOCUMENTS 1,706,121 A * 3/1929 Laughlin, Sr. et al. ..... 104/12
1,780,427 A * 11/1930 Kirkham ..... 404/119
1,887,341 A * 11/1932 Venable ..... 404/75
2,098,895 A * 11/1937 Lothar ..... 404/133.05
4,127,351 A * 11/1978 Vural ..... 404/72
4,382,715 A * 5/1983 Vural et al. ..... 404/133.05
4,493,585 A * 1/1985 Axer ..... 404/102
4,507,014 A * 3/1985 Heims et al. ..... 404/102
4,828,428 A 5/1989 Anderson
5,947,638 A * 9/1999 Heims ..... 404/102
6,019,544 A 2/2000 Emerson et al.
6,238,135 B1 * 5/2001 Rower ..... 404/84.5
6,551,018 B2 * 4/2003 Baker et al. ..... 404/102
7,591,607 B2 * 9/2009 Hall et al. ..... 404/75
8,047,742 B2 * 11/2011 Sick et al. ..... 404/133.1
8,113,737 B2 * 2/2012 Mahler et al. ..... 404/95
2002/0141823 A1 10/2002 Baker et al.
2002/0168226 A1 * 11/2002 Feucht et al. ..... 404/84.1
2011/0123267 A1 * 5/2011 Buschmann et al. ..... 404/72
2011/0123270 A1 * 5/2011 Buschmann et al. .... 404/133.05
2011/0229263 A1 * 9/2011 Buschmann et al. ..... 404/72

FOREIGN PATENT DOCUMENTS

DE 4040029 C1 4/1992

* cited by examiner

*Primary Examiner* — Gary Hartmann
(74) *Attorney, Agent, or Firm* — Fish & Richardson P.C.

(57) ABSTRACT

A method of laying a finishing layer with a road finisher F having a screed B, whereby the screed, equipped with a tamper device T and a smoothing plate, at least compacts and superficially smoothes the finishing layer, and the stroke and/or the frequency of the tamper device T are remotely varied for laying a finishing layer with a paving thickness and/or laying rate V which vary over the pave width and transversely to the working direction R within the pave width. A road finisher having a screed suitable for implementing the method set forth above wherein the road finisher or screed has an adjustment device for the remotely actuated local variation of at least the stroke of the tamper device within the pave width.

13 Claims, 2 Drawing Sheets

METHOD AND ROAD FINISHER FOR LAYING A COMPACTED FINISHING LAYER

FIELD OF THE INVENTION

The invention relates to a method of laying a compacted finishing layer of uncompacted paving material and bituminous paving material in particular, in a paving thickness (D) and with a pave width (b) on a substructure, with a road finisher having a screed, the road finisher moving the screed (B) with laying rate (V) in the working direction (R) floating on previously laid paving material, wherein the screed (B) has a tamper device (T) which has a stroke drive in front of a smoothing plate in the working direction (R) and which over the pave width (b) either comprises a continuous tamper strip or a plurality of tamper strip sections and the tamper device (T) can be operated with a selectable stroke (a) and selectable frequency at least for pre-compaction of the finishing layer before the smoothing plate at least superficially smoothes the pre-compacted finishing layer and to a road finisher (F) with a screed (B) having at least one tamper device (T) and one smoothing plate, wherein the tamper device (T) includes at least one stroke drive and at least one tamper strip in front of the smoothing plate in the working direction (R) extending over the pave width (b) of the screed (B), the tamper strip being coupled to the stroke drive arranged in the screed (B).

BACKGROUND OF THE INVENTION

When laying a finishing layer, in particular of bituminous paving material or also of concrete paving material, a relatively small positive setting angle of the screed or smoothing plate is desirable with regard to uniform compaction and good surface planeness. A positive setting angle implies that the front edge of the screed in the working direction, in the region of which the tamper device compacts the paving material, is situated higher above the formation level than the rear edge of the screed in the working direction of laying. The positive setting angle should be maintained as constant as possible, because it influences the paving thickness. The higher the compacting output applied by the tamper device, the higher the local compaction and vice versa. Since operating parameters such as the weight of the screed and the compactability of the layer material are relatively constant, the compacting output is primarily dependent on the stroke and also, though even to a somewhat slighter extent, on the frequency of the tamper device. If the laying rate reduces with the tamper device at a constant stroke and constant frequency then the compacting output increases locally, by means of which, due to the locally increasing compaction, the screed rises, the setting angle reduces undesirably and the paving thickness increases. On the other hand the local compacting output reduces for an increase of the laying rate so that the screed lowers due to the reduced compaction, the setting angle increases undesirably and the paving thickness reduces. Therefore when laying, attempts must be made, largely independently of laying parameters, such as for example the laying rate, to produce a constant compaction so as not to change the setting angle of the screed or as little as possible.

For laying in finishing layer different types of screed are used. A so-called fixed-width screed has a fixed pave width which cannot be changed when laying. The pave width of the fixed-width screed can be increased in steps in that extension parts are fitted to the ends of the fixed-width screed. Each extension part also has a tamper device and a smoothing plate, equipped with an unbalance vibrator if required. Alternatively to the fixed-width screed, an extending screed is used if the pave width has to be varied during laying. In the extending screed extendable and retractable telescopic screed parts are arranged on both ends of a basic screed with a fixed pave width. The basic screed and the telescopic screed parts each have tamper devices. If the maximum pave width of the extending screed is not sufficient, then extension parts, which are each equipped with a tamper device and a smoothing plate can be fitted to the ends of the telescopic screed parts. With all types of screeds the tamper device is operated with the same stroke and the same frequency over the entire pave width.

When laying finishing layers, in particular of bituminous paving material, it is often necessary to lay a finishing layer with a variable paving thickness transverse to the working direction of travel for laying, e.g. when the surface of the finishing layer and/or the formation level has a transverse slope or a straight finish from the shoulder to the center line or a special profile, for example with a concave parabolic profile is to be produced or unevenness in the formation level is to be compensated. Furthermore, the laying rate inevitably varies over the pave width when laying a finishing layer on a traffic roundabout or along a sharp curve. Both effects, i.e. the varying paving thickness or the varying laying rate, lead alternatively or additively for constant stroke and similarly also constant frequency of the tamper device over the pave width to unwanted reactions in the final quality of the finishing layer, such as undesired variations in paving thickness and/or different degrees of compaction over the pave width. These undesired reactions or sacrifices in quality have so far been accepted as unavoidable.

As shown below based on examples, although it is known how to variably control the compaction produced by the tamper device depending on the changing laying parameters, the same control is always applied over the full pave width of the screed, whereby the requirements for a paving thickness varying over the pave width or a laying rate varying over the pave width cannot be taken into account.

With the screed known from DE 4 139 702 C2 the angle between the direction in which the tamper device compacts and, for example, the smoothing plate of the screed is adjustable in order to adapt the compacting output to harder or softer paving material. However, the compacting output is in each case the same over the entire pave width.

With the method known from DE 4 040 029 C1 the frequency of the tamper device of the screed is controlled along a set-point curve according to the actual laying rate in order to maintain the compacting output of the tamper device essentially constant independently of the changes in the laying rate, i.e. to reduce the frequency for a slowing laying rate and to increase it for a quickening laying rate. The stroke of the tamper device remains unchanged over the pave width. Alternatively, with an interruption in laying, the stroke of the tamper device can be changed manually in steps. Since the frequency control of the tamper device however also occurs over the entire pave width in the same manner, the requirements of the paving thickness or the laying rate varying over the pave width are not taken into account.

With the road finisher known from DE 19 836 269 C1 the frequency of the tamper device varies in dependence of changes of the positive setting angle of the screed so that the setting angle proportionally controls the frequency to compensate for negative effects of changes in the laying rate. Here too, the frequency is varied uniformly over the entire pave width.

From the technical information publication "Vögele—Für jede Aufgabe die richtige Einbaubohle" (Vögele—The right screed for each task), published by Josef Vögele AG, Neckarauerstr. 168-228, D-68146 Mannheim, No. 2400/10, printed in February 1997, in particular on pages 4 and 5, tamper devices with hydraulically powered tamper strips are known, whose operating frequency can be varied via the rotational speed of the hydraulic drive and whose stroke can be varied by the manual adjustment of the correspondingly effective eccentricity of an eccentric drive shaft. Furthermore, it is known from this that also the smoothing plate of the screed can be fitted with an unbalanced vibrator, the frequency of which can be varied by control of the rotational speed. Furthermore, the tamper device may produce only pre-compaction of the paving material and, where required, final compaction is carried out by hydraulically powered press strips behind the smoothing plate in the working direction. It is pointed out on page 6 that the stroke of the tamper device determines the maximum possible compression, i.e. the degree of compaction, and the stroke can be adjusted manually in steps for various stroke values, whereby the degree of compaction achieved can also even be increased by increasing the stroke frequency.

With a screed known from US 2002/0141823 A1 the tamper strip, which extends continuously over the pave width, consists of separate tamper strip sections which can be joined together. Each tamper strip section is driven by at least one control cam. The control cams of all tamper strip sections are arranged on a common drive shaft which is supported in the screed and is driven at a required rotational speed. The control cams are phase shifted to one another so that the tamper strip sections pre-compact with a phase offset to one another. The stroke and the stroke frequency are the same for the tamper strip sections so that a uniform pre-compaction output is produced over the working width across the working direction. A remotely actuated variation of the stroke and/or the frequency over the pave width is not elucidated.

With the screed known from U.S. Pat. No. 4,828,428 A two continuous tamper strips are provided at least over the working width of a screed section in front of the smoothing plate of the screed in the working direction, the said tamper strips being actuated by a common drive or separate drives. The stroke and/or the frequency of the tamper strip is the same over the pave width of the screed section. The strokes and the relative timing of the tamper strips can be adjusted. To change the timing either a timing chain is redeployed or exchanged. To change the stroke in steps the relevant eccentric drive components on the drive shaft are exchanged. A variation of the stroke and/or the frequency within the pave width of the screed section and transverse to the working direction is not elucidated.

With the screed known from U.S. Pat. No. 6,019,544 A no tamper devices are provided on the basic screed and the extending screeds, but rather telescopic screed parts are only provided on screed extension parts, which are mounted either in telescopic screed parts or on the outside of the basic screed. These tamper devices with just a tamper strip extending in the outermost marginal region of the finishing layer transversely to the working direction are used for pre-compacting the edges of the finishing layer. Each tamper strip is supported inside in the screed extension part, pivotable about an axis orientated in the working direction, and is actuated on the outer end by a crank mechanism and is pivoted up and down about the pivot axis. The stroke applied to the outer end of the tamper strip can be manually adjusted after removal of the covers and adjustment of a turnbuckle. A paving thickness and/or laying rate varying over the working width is not mentioned.

Finally, it has already been suggested (European Patent Application with the file number 09014516 and prior seniority) that a remote controllable adjustment device is provided for an eccentric stroke drive of a tamper strip of the tamper device on a screed, with which the stroke can change in dependence of the changing laying parameters even in laying operation over the entire pave width.

OBJECT OF THE INVENTION

The object of the invention relates to a method of the type mentioned in the introduction and to a road finisher suitable for implementing the method, with which it is possible to maintain final quality of the finishing layer in and transverse to the working direction essentially constant despite unavoidable influences on the paving thickness and/or the laying rate varying over the pave width.

The object is achieved with the method and the road finisher of the present invention.

According to the method it is possible for the first time to operate at least the tamper device over the pave width and thus transversely to the working direction with a variable stroke and/or variable frequency, and in this way to match the compacting output within the pave width to locally varying paving thicknesses and laying rates such that a constant height and consistent quality is produced in the laid finishing layer in the working direction and transversely to it with variable compacting output. The local compacting output of the tamper device is so to speak adjusted within the pave width to local conditions, such as the local paving thickness and/or the laying rate so that ultimately over the entire pave width the screed operates with the desired positive, relatively small and essentially constant setting angle and the compaction is produced varying and individually adapted over the working width. Primarily at least the stroke of the tamper device is varied transversely to the working direction. Also varying the frequency within the pave width may be advantageous as an accompanying measure. Optionally, it is sufficient to vary only the frequency within the pave width.

With the adjustment device which the road finisher or the screed exhibits, along with a possibility at least of the remote controlled changing of the stroke, the compacting output produced within the pave width can be varied as demanded by the local paving thickness and/or the laying rate. Using the adjustment device, at least the stroke of the tamper device is varied over the pave width in adaptation to local laying parameters. The variation can be set already before the start of laying, but can be carried out at any time also during laying operation. The adjustment device offers either a tool for use by the driver of the vehicle or an automatically operating tool for reaction to locally varying paving thicknesses and laying rates with locally variable settings at least of the stroke of the tamper device. The final quality of a finishing layer laid with the road finisher is uniformly high despite a paving thickness and/or laying rate which varies transversely to the working direction.

SUMMARY OF THE INVENTION

With an expedient embodiment of the method the progression of the paving thickness and/or the surface of the formation level and/or the laying rate is determined and the stroke and/or the frequency of the tamper device is locally varied taking into account the determined progression transverse to the working direction. For the determination the data from the formation level, from the screed settings and from actual measurements of appropriately positioned sensors can be included in order to be able to regulate through open or closed-loop control the variation preliminarily or essentially without temporal delay, either directed by the vehicle driver or in an automatic process by means of a computerized open or closed-loop control device.

With a further, expedient embodiment the variation occurs based on at least one characteristic which is determined beforehand. Expediently, a plurality of characteristics or also families of characteristics can be stored and then a selection can be made either by the vehicle driver or automatically.

Furthermore, it may be expedient to realize the variation of the stroke and/or of the frequency in steps or continuously within the pave width in sections of the tamper device. Even with sectional variation a relatively good adaptation to variations in the paving thickness or laying rate can be achieved over the pave width, because variations of this nature are normally not sudden, but rather relatively permanent or harmonic.

Particularly expediently, the variation of the stroke and/or of the frequency is also carried out with laying in progress in order to be able to take changes to the paving thickness or laying rate in the working direction into account.

With an expedient embodiment of the road finisher the frequency of the tamper device can also be locally variably adjusted within the pave width by means of the adjustment device for the stroke or by means of an additional adjustment device for the frequency.

Expediently, the adjustment device can be operated automatically, preferably with predetermined characteristics or families of characteristics for the variation of the stroke and/or of the frequency. The automatically operated adjustment device can make use of signals from appropriately positioned sensors and entered information which replicates the relevant actual state of the laying relationships or laying parameters or their changes.

With an expedient embodiment the tamper strip in the tamper device of the screed is divided within the pave width into a plurality of tamper strip sections. Here, it is quite possible to provide a plurality of tamper strip sections one behind the other in the relevant section in the working direction. Each tamper strip section is coupled to one of a plurality of stroke drives provided in the screed. For the relevant tamper strip section at least one locally individual stroke can be set by means of the adjustment device and optionally the frequency can also be locally individually adjusted.

With an expedient embodiment the relevant stroke drive is a connecting-rod eccentric drive with an eccentric shaft which can be rotationally driven. Alternatively, a bell-crank eccentric drive could also be provided. The amount of eccentricity and/or the driven rotational speed of the eccentric shaft can be individually adjusted for at least one tamper strip section.

With another embodiment the relevant stroke drive is a hydraulic lifting cylinder drive, whereby by means of the adjustment device the piston stroke and/or the piston reciprocation frequency can be adjusted for at least one tamper strip section, preferably by adjustment of the pressure and/or the amount per pressure pulse and/or the pressure pulse frequency of the hydraulic admission flow of the lifting cylinder drive.

In the latterly mentioned cases it may be expedient if each tamper strip section is coupled to the stroke drive via at least two couplings which transfer the stroke and the frequency of the stroke drive. For the couplings of this tamper strip section the same or even also different strokes can be set. If different strokes are set, preferably a joint with at least one degree of freedom can be provided for each coupling. In this case at least the stroke is continuously varied over the length of the tamper strip section, optionally at constant frequency. To then be able to restrict the tamper strip section relative to the stroke drive the joint can be a hinge or similar component or also just a predetermined bending point.

DESCRIPTION OF THE DRAWINGS

Embodiments of the object of the invention are described based on the drawings. The following are shown.

DETAILED DESCRIPTION OF THE INVENTION

Figure 1:
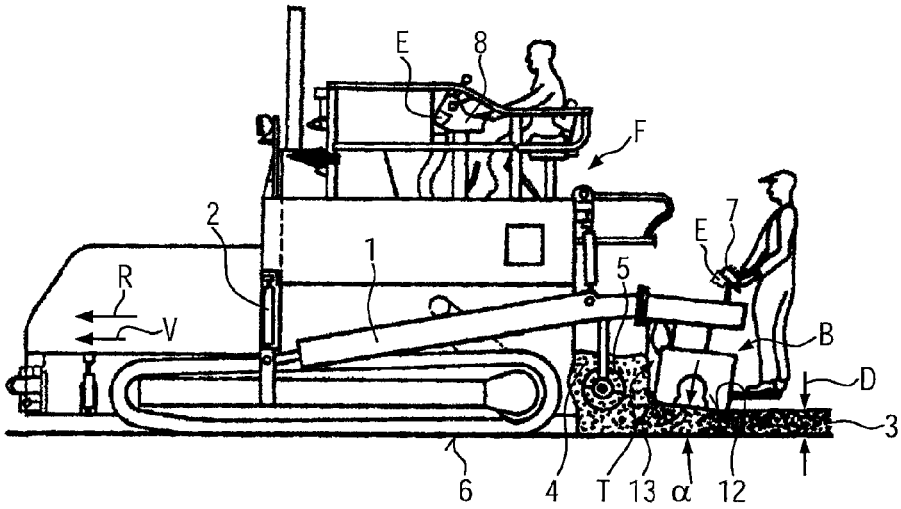
FIG. 1 a schematic side elevation of a road finisher laying a finishing layer with a screed, FIG. 2 a schematic front elevation on the exemplary screed of FIG. 1 when laying a finishing layer with a pave thickness varying over the pave width, FIG. 3 a partial section of a tamper device of the screed in a schematic front elevation, FIG. 4 a partial section of a tamper device of the screed in a schematic front elevation, and FIG. 5 a schematic front elevation of a screed when laying a finishing layer with a concave parabolic profile.

In FIG. 1, using towing spars 1, a road finisher F tows a screed B, which is moved floating with a small positive setting angle $\alpha$ relative to a formation level 6 on pre-placed uncompacted paving material 4, e.g. bituminous paving material, with a laying rate V in the working direction R, and lays a smoothed and compacted finishing layer 3 in a paving thickness D on the formation level 6. The setting angle $\alpha$, which has a contributory effect on the paving thickness D, is in part set by height adjustment of front anchorage points of the towing arms 1 on the road finisher F by means of hydraulic cylinders 2 and should be maintained as constant as possible during laying.

In the working direction R in front of the screed a transverse spreader device 5 is provided for the uncompacted paving material 4. On the front side in the working direction the screed has a tamper device T with which the paving material 4 is compacted. Furthermore, on the underside of the screed B a smoothing plate 12 is provided, which smoothes the surface of the finishing layer 3 and, as indicated, is optionally fitted with unbalance vibrators, which assist the tamper device T during compaction.

Also in the working direction behind the smoothing plate 12, the screed B can have, if expedient, a high compaction device (not illustrated) with hydraulically powered press strips.

An external control position 7 can be provided on the screed B, whereas the road finisher F has a control console 8 in a driver's cab. Furthermore, in the road finisher F, for example on the control console 8 or/and in the external control position 7, an adjustment device E is provided with which at least the stroke of the tamper device T (a tamper strip 13 processing the paving material 4) can be individually varied over the pave width b (FIG. 2) of the screed B. Expediently, the frequency, with which the tamper device T operates, can be individually varied by means of the adjustment device E or a separate adjustment device, which is not illustrated, within the pave width b.

The screed B can be a fixed-width screed with a fixed pave width onto which side extension parts can be fitted as required which then also have a tamper device T and a smoothing plate 12, whereby the tamper device T is then functionally linked to the adjustment device E. Alternatively, the screed B can be an extending screed with a basic screed and side extendable and retractable telescopic screed parts (refer to FIG. 2), the pave width b of which is variable, whereby in each case at least one tamper device T and one smoothing plate 12 are provided in the basic screed and in the telescopic screed parts. If required, on the telescopic screed parts further extension parts can be mounted which then also have a tamper device T and a smoothing plate 12.

Figure 2:
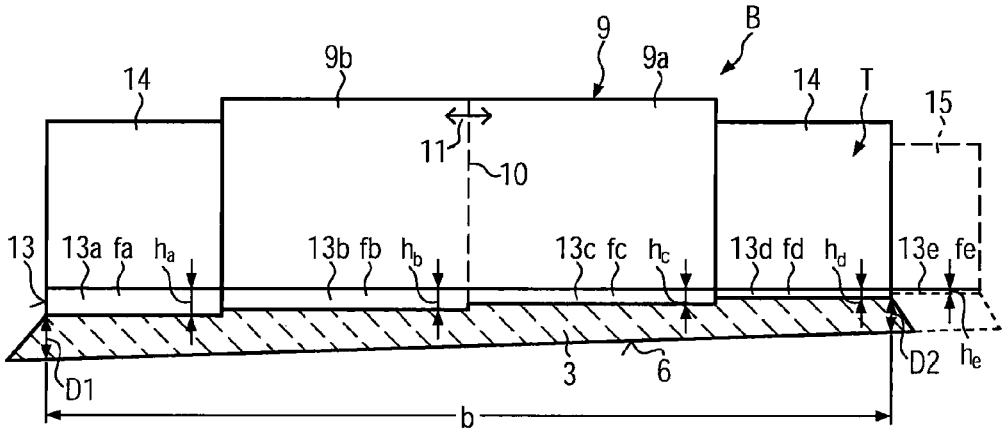

FIG. 2 elucidates the screed B in an embodiment as an extending screed with a basic screed 9 and two telescopic screed parts 14. A mounted extension part 15 is indicated with dashed lines at one end of a telescopic screed part 14. In this schematic illustration the smoothing plate 12 is shown as a continuous straight line, although it is divided into sections. The tamper device T or the tamper strip 13 of the screed B is divided within the pave width b into a plurality of sections 13*a*-13*e*, for example in each case with a section in the telescopic screed parts 14, in the basic screed 9 and in the extension part 15. In the basic screed 9 a division 10 is indicated dashed where the basic screed 9, e.g. for producing a straight finish from the shoulder to the center line in the finishing layer surface (not illustrated), can be folded down by means of an adjustment drive 11.

The basic screed 9 can have a continuous tamper strip section 13*b*. Expediently however, at least two tamper strip sections 13*b*, 13*c* are provided in the basic screed 9.

The finishing layer 3 laid on the formation level 6 has a wedge-shaped cross-section, i.e. a paving thickness D which here essentially continuously reduces from left to right within the pave width b (maximum dimension D1, minimum dimension D2). Corresponding to the change in the paving thickness from D1 to D2 (the extension part 15 has been initially ignored here), the individual strokes of the tamper strip sections 13*a*-13*d* within the pave width b can be set differently, for example so that each tamper strip section in each case produces the same compaction despite the varying paving thickness. The tamper strip section 13*a* here operates with the largest stroke $h_a$. The strokes $h_b$ to $h_d$ are stepwise smaller than the stroke $h_a$. The different strokes $h_a$ to $h_d$ are remotely set by means of the adjustment device E (refer to FIG. 1) either before starting laying or during laying operation and/or are set during laying operation.

Alternatively or in addition the frequency f of the strokes h can be individually adjusted for each tamper strip section 13*a*-13*d* within the pave width b, if this is regarded as expedient, and as indicated by the references $f_a$ to $f_d$. This can imply that the frequency $f_a$ is the highest and the frequency $f_d$ is the lowest or vice versa. Changes to the stroke of each tamper strip section 13*a*-13*d* can be remotely set continuously or also in predetermined steps. The same applies to the frequency.

Since each tamper strip section 13*a*-13*d* functionally interacts with the following smoothing plate 12, it is important that the respective top dead center of a stroke of a tamper strip section is relatively precisely matched to the smoothing plate 12, which is indicated in FIG. 2 by the lower edge of the tamper strip sections 13*a*-13*d* which penetrate the paving material to different depths. If a high compaction device is to be provided or a plurality of vibration devices on the smoothing plates 12, their compacting outputs could also be varied within the pave width b.

Figure 3:
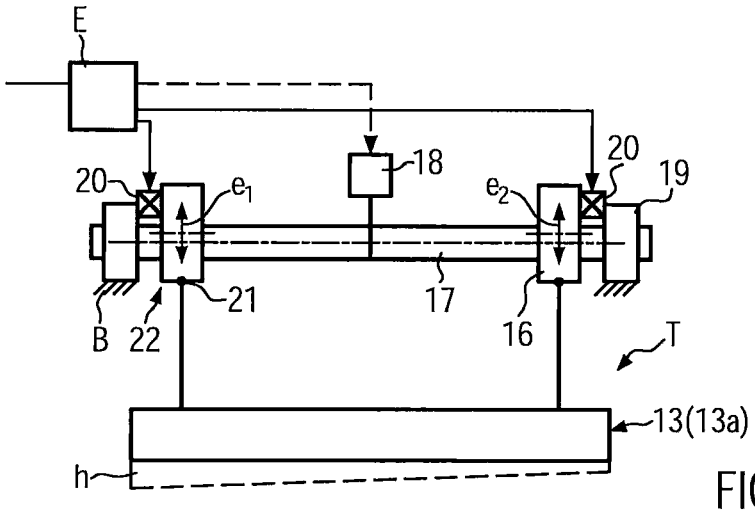

FIG. 3 schematically illustrates a section of the tamper device of the screed B. The tamper strip section 13*a* is coupled to at least two couplings 16, for example in each case a type of connecting rod, with a stroke drive 22. The stroke drive 22 includes an eccentric shaft 17, rotationally drivable by means of a rotational drive 18 (e.g. a hydraulic motor), and which is pivotably supported in bearings 19 in the screed B and in which coupling 16 bears pivotably arranged cams, which are not illustrated, from the rotation of which the strokes of the tamper strip sections 13*a* are derived via the couplings 16 (eccentricities e1, e2). The tamper strip section 13*a* can, for example, be guided movably on the front side of the smoothing plate 12. In the stroke drive 22 an actuator 20 is also provided with which the respective eccentricity e1, e2 can be rotated relative to the eccentric shaft 17 and/or the coupling 16 and in fact by means of the adjustment device E. In this way the stroke h of the tamper strip section, e.g. 13*a*, derived from the eccentricity e1, e2 is changed. If the frequency is also to be changed, the adjustment device E also controls the rotational drive 18 individually and in the case of a hydraulic motor, for example, via a flow control valve. If the eccentricities e1 and e2 are the same, the couplings 16 can be rigidly connected to the tamper strip section 13*a*. If, where possible, the eccentricities e1 and e2 can be set differently in order to set a continuous variation of the stroke a of the tamper strip section 13*a* over its length, it is expedient to provide at least one joint 21 which has at least one degree of freedom (for example, a hinge or a predetermined bending point).

Figure 4:
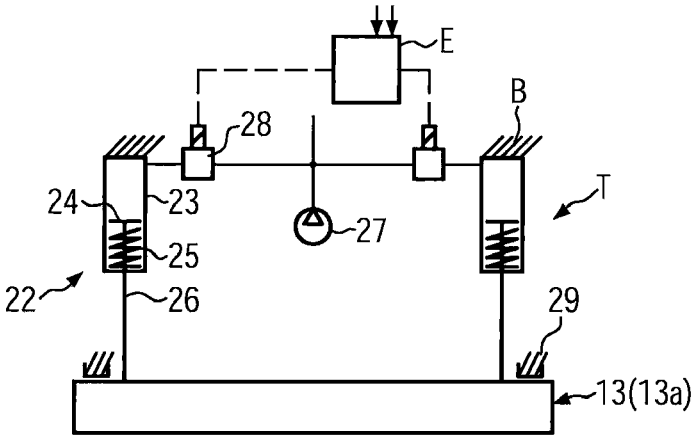

FIG. 4 illustrates another embodiment of the stroke drive 22 for the tamper strip section 13*a*. In this respect two hydraulic reciprocating drives 23 are supported stationary in the screed B and their pistons 24 are coupled to the tamper strip section 13*a* via piston rods 26. The limit stops 29 of the screed can limit the upper stroke reversal point of the tamper strip section 13*a*. The reciprocating drives 23 involve, for example, hydraulic pressure pulse cylinders operating against return springs, for example spring-loaded cylinders although also hydraulic double-acting cylinders could be used. The hydraulic supply occurs via control elements 18 from a pressure source 27, whereby the adjustment device D acts on the control elements 28. Due to the setting of the hydraulic pressure and/or the amount, the stroke of the piston 24 can be selected for any pressure pulse, depending on how the adjustment device E drives the control element 28. The individual stroke of the tamper strip section 13*a* can be set the same on both reciprocating drives 23 or differently, analogously to FIG. 3. Within the pave width b a plurality of individually adjustable sections of this nature are provided.

Figure 5:
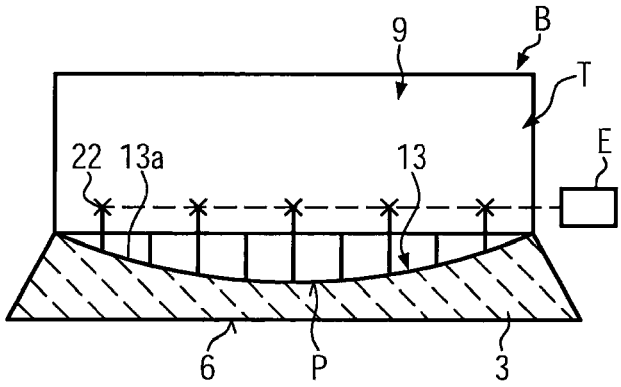

FIG. 5 illustrates a special form of a screed B which is designed for laying a finishing layer 3 with a concave parabolic surface profile P, for example on an at least essentially even formation level 6. The tamper device T or its tamper strip 13 is divided over the pave width in a plurality of sections, which for example, as also the smoothing plate, define the parabolic profile P and are coupled to individual stroke drives 22. The strokes of the tamper strip sections 13*a* can be varied over the pave width b, adapted to the parabolic profile P, such that locally varying compacting outputs are produced so that an essentially constant degree of compaction results over the pave width b.

The adjustment device E is operated in each case either by the vehicle driver or an operator on the screed B or it operates automatically and/or makes use of signals from sensors which are not illustrated and which determine the relevant laying parameters. Expediently, the adjustment device E operates with stored characteristics or families of characteristics, which have been determined beforehand and from which a selection can be made and also entries, e.g. as setpoint values, are processed, for example in a computerized and optionally programmable closed-loop control system.

According to the invention the road finisher F or the screed B thus offers a tool and the possibility of responding to locally varying paving thicknesses and laying rates within the working width with locally different settings at least for the stroke and optionally also for the frequency of the tamper device.

In order to achieve a still higher resolution amongst the possible adjustments, for example of the screed B of FIG. 2, more tamper strip sections than illustrated, each with its own stroke drives or stroke setting possibilities, could be provided in the telescopic screed parts 14, in each extension part 15 and in the basic screed 9 or in each basic screed part 9*a*, 9*b*.

What is claimed is:

1. Method of laying a compacted finishing layer of uncompacted paving material, on a substructure, with a road finisher having a screed including at least two stroke drives and at least two tamper strips arranged one behind the other in the transverse direction and in front of a smoothing plate, which comprises moving the screed in the working direction by floating the screed on a previously laid paving material, operating each tamper strip using an individually selectable stroke and using an individually selectable frequency for each tamper strip to pre-compact at least the finishing layer, the thickness and/or laying rate of the finishing layer varying transversely to the working direction of the road finisher, varying the stroke and/or the frequency of the tamper over the pavement width while laying is in progress, superficially smoothing the pre-compacted finishing layer with the smoothing plate, and matching the compacting stroke of each tamper strip to the locally varying paving thickness and/or pavement laying rate by remotely controlling the stroke of each tamper strip within the pavement width.

2. Method according to claim 1, which comprises determining the progression of the paving thickness and/or the surface of the substructure and/or the laying rate transverse to the working direction and within the pavement width with signals produced by sensors and locally varying the stroke and/or the frequency transversely to the working direction in adaptation to the determined progression.

3. Method according to claim 1, which comprises adjusting the variation of the stroke and/or the frequency over the working width according to a predetermined characteristic.

4. Method according to claim 1, which comprises varying the stroke and/or the frequency of the tamper device within the pavement width in sections of the tamper device.

5. Road finisher with a screed having at least one tamper device and one smoothing plate, the tamper device including at least two stroke drives for generating frequent strokes and at least two tamper strips in front of the smoothing plate in the working direction, the tamper strips extending transverse to the working direction over the pavement width of the screed and being coupled to the stroke drives in the screed and wherein the road finisher or the screed includes an adjustment device for remotely actuating local variation of at least a stroke of a single tamper strip independently of the other tamper strips of the tamper device within the pavement width and transverse to the working direction of the road finisher while the laying progress.

6. Road finisher according to claim 5, wherein the adjustment device is formed for varying the frequency of the tamper strips within the pavement width.

7. Road finisher according to claim 5 wherein the adjustment device has an automatic adjustment or closed-loop control system, with predetermined characteristics of varying the stroke and/or the frequency among the tamper strips and within the pavement width.

8. Road finisher according to claim 5, wherein the tamper strip) is divided within the pavement width into a plurality of tamper strip sections, each one of the strip sections being coupled to one of a plurality of stroke drives and for which a locally individual stroke and/or a locally individual frequency can be adjusted within the pavement width with the adjustment device.

9. Road finisher according to claim 5, wherein the respective stroke drive is a connecting-rod eccentric drive with a drivable eccentric shaft and the respective eccentricity and/or the drive speed of the eccentric shaft is adjustable for the tamper strip section with the adjustment device.

10. Method of laying a compacted finishing layer of uncompacted paving material in a first paving thickness and with a first pavement width on a substructure which comprises moving a road finisher having a screed with a tamper device comprising at least two stroke drives and at least two tamper strips in front of a smoothing plate at a first laying rate in the working direction of the road finisher, independently selecting the stroke of each tamper strip during operation of the tamper device and independently selecting the frequency for each tamper strip during operation of the tamper device to at least pre-compact the finishing layer, and matching the compacting output of the tamper device to the locally varying paving thickness and/or laying rate by remotely controlling variation of the stroke of the tamper device within the pavement width and during operation of the tamper device, the thickness and/or laying rate of the finishing layer varying transversely to the working direction of the road finisher.

11. Road finisher comprising a screed having at least one tamper device and one smoothing plate, the tamper device including at least one stroke drive and at least one tamper strip in front of the smoothing plate in the working direction and extending transverse to the working direction over the pavement width of the screed, the tamper strip being coupled to the stroke drive, and the road finisher having an adjustment device for remotely actuated local variation of the selectable stroke of the tamper strip of the tamper device within the pavement width and transverse to the working direction of the road finisher.

12. The method of claim 1 wherein the tamper device comprises a plurality of tamper strip sections.

13. The method of claim 12 wherein the tamper strip sections are arranged behind one another in a direction transverse to the travelling direction of the road finisher and across the full pavement width of the screed.

* * * * *